US005950810A

United States Patent [19]

Pan et al.

[11] Patent Number: 5,950,810

[45] Date of Patent: Sep. 14, 1999

[54] ELASTIC APPARATUS FOR A KEYSWITCH KEY OF A KEYBOARD AND THE KEYSWITCH KEY USING THE SAME

[75] Inventors: Hua-Tsong Pan, Taipei; Ming-Yow Hon, Yung-Ho City, both of Taiwan

[73] Assignee: Hon Hai Precision Ind. Co., Ltd., Taipei Hsien, Taiwan

[21] Appl. No.: 09/024,942

[22] Filed: Feb. 17, 1998

[30] Foreign Application Priority Data

Feb. 15, 1997 [TW] Taiwan ..... 86202805

[51] Int. Cl.[6] ..... H01H 13/70

[52] U.S. Cl. ..... 200/344

[58] Field of Search ..... 200/5 A, 512, 200/517, 341, 344, 345, 490, 491, 491.2, 495, 495.1; 400/490, 491, 491.2, 495, 495.1

[56] References Cited

U.S. PATENT DOCUMENTS

| | | | |
|---|---|---|---|
| 3,829,646 | 8/1974 | Lorteije et al. | 200/159 B |
| 4,518,833 | 5/1985 | Watkins | 200/5 A |
| 4,862,499 | 8/1989 | Jekot et al. | 379/368 |
| 5,386,091 | 1/1995 | Clancy | 200/517 |
| 5,630,501 | 5/1997 | Tsay | 200/344 |
| 5,704,467 | 1/1998 | Jarvis | 200/302.2 |
| 5,763,842 | 6/1998 | Tsai et al. | 200/5 B |
| 5,829,579 | 11/1998 | Tsai | 200/344 |

*Primary Examiner*—Michael Friedhofer

[57] ABSTRACT

An elastic apparatus used in a keyswitch key of a keyboard includes a bell-shaped shell having a top plate from which a receptacle extends upward for engaging with a keycap and from which an impacting portion projects downward and a base flange radially extends from a bottom peripheral edge of the bell-like shell for exerting a resilient force when the keycap is depressed to cause deformation of the elastic apparatus. A keyswitch key using the elastic apparatus is also disclosed for activating and deactivating a circuit unit which is positioned a predetermined distance below the impacting portion of the elastic device in an undepressed status and which is depressed by the impacting portion of the elastic device during depression of the keycap.

7 Claims, 5 Drawing Sheets

ELASTIC APPARATUS FOR A KEYSWITCH KEY OF A KEYBOARD AND THE KEYSWITCH KEY USING THE SAME

BACKGROUND OF THE INVENTION

1. Field of The Invention

The present invention relates to an elastic apparatus for a keyswitch key in a keyboard, and particularly to an elastic apparatus which can be easily positioned in the keyswitch key of the keyboard without resulting in unwanted displacement or inclination thereof with respect to a horizontal base of the keyswitch key.

2. The Prior Art

Keyboards are the most popular input devices for personal computers. Each key of a conventional keyboard generally has a cap connected to a scissors-like mechanism and an elastic device for generating a resilient force during clicks. Generally, conventional elastic devices may be classified into spring-type and rubber-type structures. The spring-type structure is commonly used in the keyboard of a desktop computer. However, the spring-type structure can not satisfy the trend of the PC market toward increasing compactness due to the requirement of at least a minimum length of the spring to exhibit a sufficient resilient force for recovering the keyswitch key back to its undepressed status after manual release there. The rubber-type structure was introduced to overcome the minimum length limitation of the spring-type structure. Although the conventional rubber-type structure meets the compactness requirement, the keyswitch thereof is prone to declination or displacement during clicks. Moreover, most of the present keyswitch keys will generate noise during clicks thus affecting a user's concentration.

Therefore, it is requisite to provide an improved structure of the elastic device for the keyswitch key and a new keyswitch key which can reduce the noise during clicks into a minimum level.

SUMMARY OF THE INVENTION

The primary purpose of the present invention is to provide an improved elastic apparatus used in a keyswitch key of a keyboard for preventing declination or displacement of the keyswitch key during clicks.

Another purpose of the present invention is to provide an improved keyswitch key including an improved elastic member by which the noise during clicks can be reduced to a minimum level.

In accordance with one aspect of the present invention, an elastic apparatus is provided for use in a keyswitch key of a keyboard which includes a keycap having an engagement protrusion projecting downward therefrom. The elastic apparatus comprises a shell portion having a top plate and a curved periphery projecting downward from a peripheral edge of the top plate and defining a cavity therein. A hollow neck portion projects upward from a peripheral edge of the top plate of the shell portion and defines a recess therein for securely receiving the engagement protrusion of the keycap. An impacting portion projects downward from the top plate. A base flange radially extends from a bottom peripheral edge of the shell portion for exerting an upward resilient force when the elastic apparatus is depressed.

In accordance with another aspect of the present invention, a keyswitch key of a keyboard comprises a keycap; a scissors-like structure having an upper portion supported by the keycap, and a lower portion; an elastic member firmly connected with the keycap and located in a space defined by the scissors-like mechanism and comprising a shell portion which has a top plate, a receptacle portion projecting upward from a peripheral edge of the top plate of the shell portion, a base flange radially extending from a bottom peripheral edge of the shell portion, and an impacting portion projecting downward from the top plate of the shell portion; a positioning frame defining a hole in a center thereof for retaining a periphery of the shell portion adjacent to the base flange thereof, positioning means formed on an upper surface of the positioning frame for supporting the lower portion of the scissors-like mechanism, and a second recess defined in a lower surface of the positioning frame for retaining the base flange of the elastic member therein; and a circuitry member including a circuit unit confronting the impacting portion of the elastic member whereby depression of the impacting portion of the elastic portion causes a switch-on status of the circuit unit and returns to a switch-off status upon release of the impacting portion.

Further in accordance with another aspect of the present invention, a keyswitch key of a keyboard comprises a keycap, a scissors-like structure having an upper portion supported by the keycap, and a lower portion. An elastic member is firmly connected with the keycap and located in a space defined by the scissors-like mechanism and comprises a shell portion which has a top plate, a receptacle portion projecting upward from a peripheral edge of the top plate of the shell portion, a base flange radially extending from a bottom peripheral edge of the shell portion, a plurality of protrusions projecting upward from the base flange, and an impacting portion projecting downward from the top plate of the shell portion. A positioning frame defines a first hole in a center thereof for retaining a periphery of the shell portion adjacent to the base flange thereof and a plurality of second holes for receiving the protrusions of the elastic member and allowing upper portions of the protrusions to extend beyond the positioning frame. Positioning means formed on an upper surface of the positioning frame is used to support the lower portion of the scissors-like mechanism. A circuitry member includes a circuit unit confronting the impacting portion of the elastic member. Whereby depression of the impacting portion causes a switch-on status of the circuit unit and returns to a switch-off status upon release of the impacting portion. Whereby the extended upper portions of the protrusions of the elastic member abut against a lower periphery of the keycap in order to absorb an impact therefrom when the keycap is depressed with an external force beyond an operative force of activating the keyswitch key.

DETAILED DESCRIPTION OF THE PREFERRED EMBODIMENTS

Figure 1:
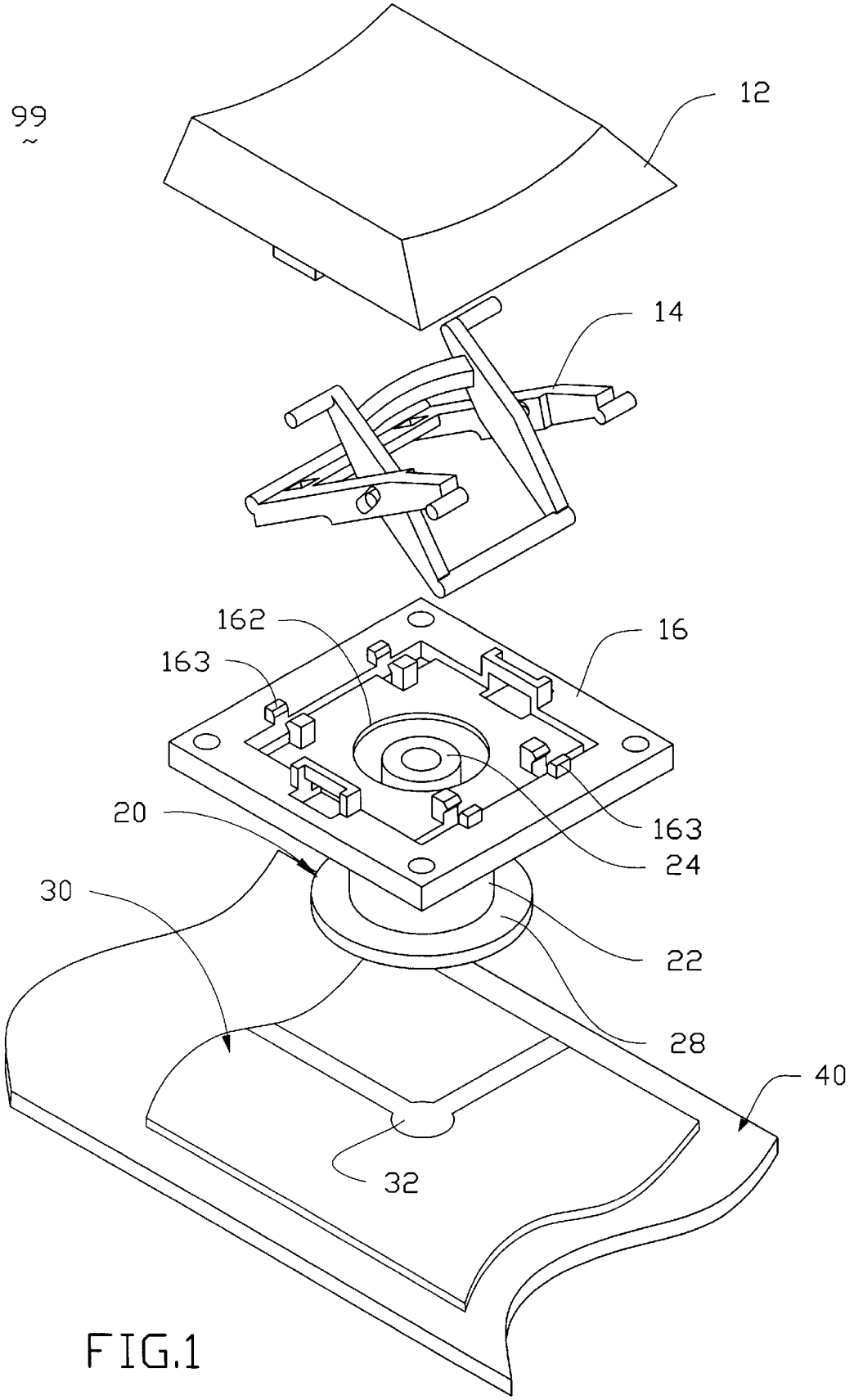
FIG. 1 is an exploded view of a keyswitch key including an elastic apparatus in accordance with a first embodiment of the present invention.
Figure 2:
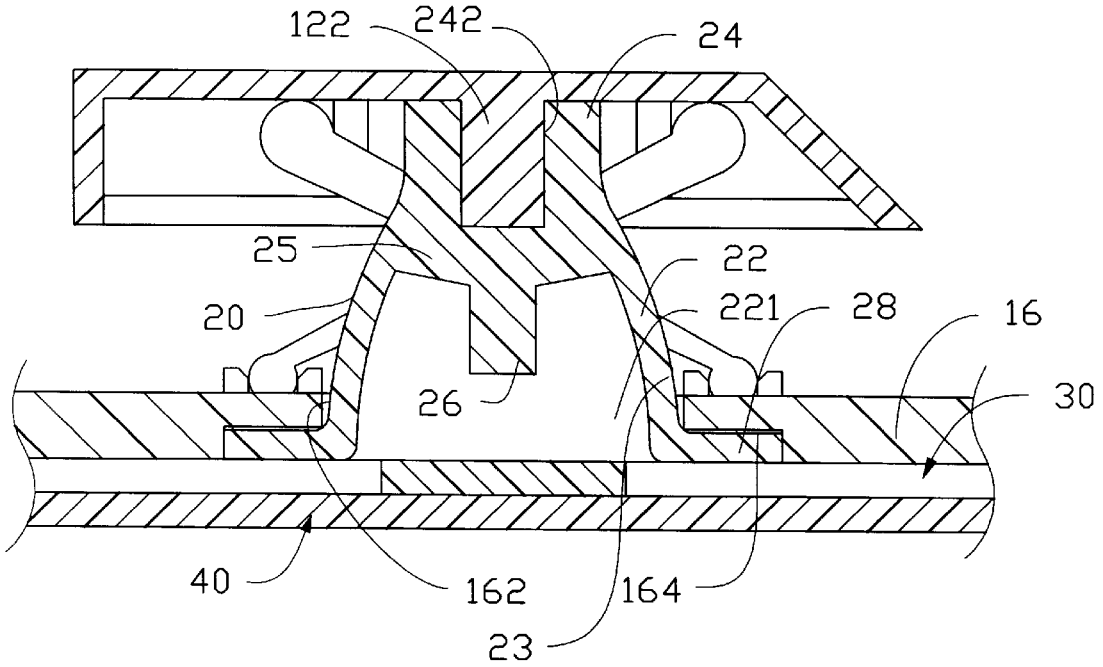
FIG. 2 is a cross-sectional view of an assembly of the keyswitch key showing the engagement relation between the elastic apparatus and the keyswitch key.
Figure 3:
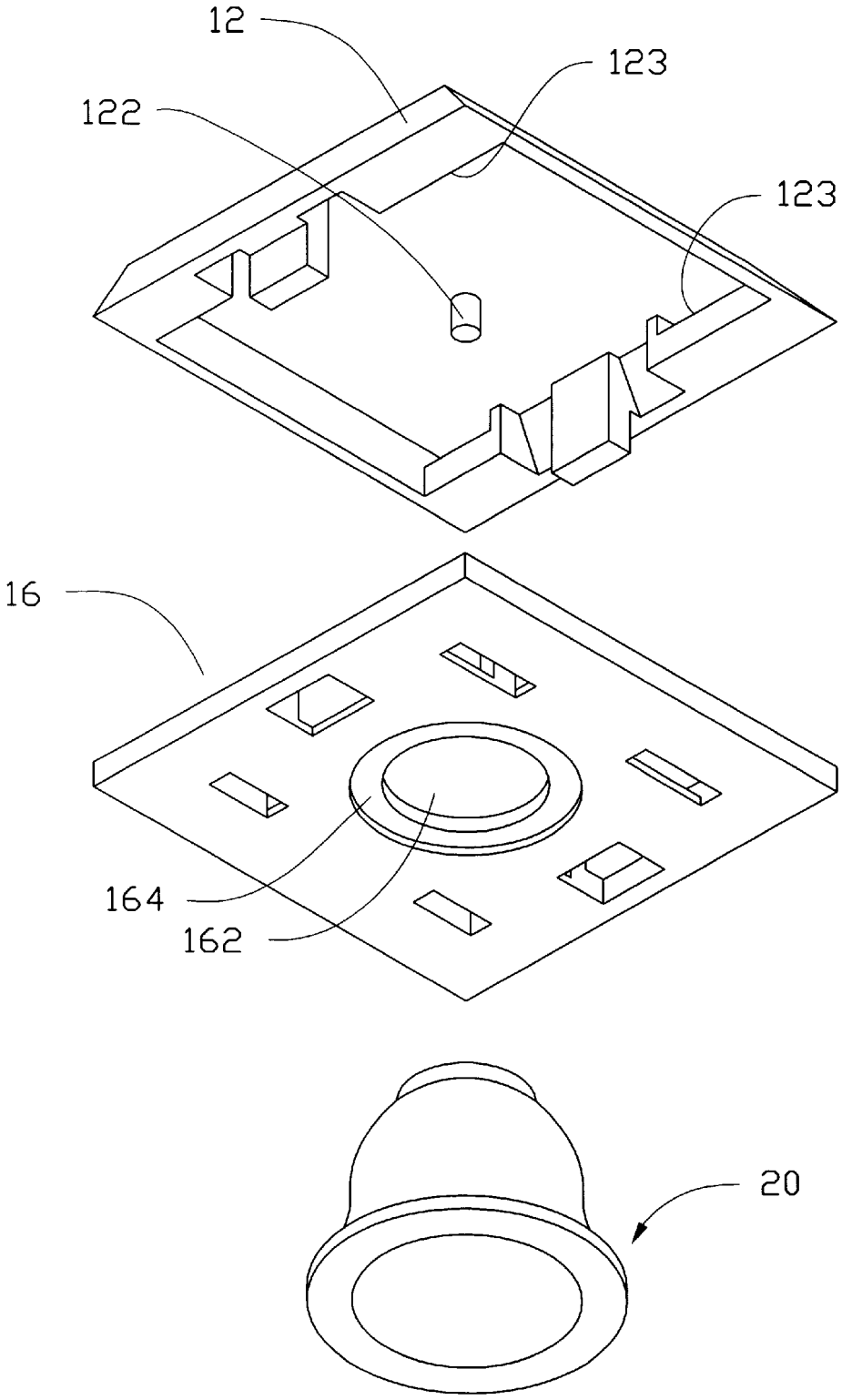
FIG. 3 is an exploded view of a keycap, a base, and the elastic apparatus taken from a bottom direction thereof.

Referring to FIGS. 1, 2 and 3, a keyswitch key 99 in accordance with the present invention for use in a keyboard of a computer comprises a keycap 12, a scissors-like linkage mechanism 14, a positioning socket 16, an elastic apparatus 20, a circuitry thin film 30, and a conductive base 40. The keycap 12 forms an engagement protrusion 122 projecting downward from a center portion thereof and a plurality of supports 123 around an inner periphery thereof for supporting an upper portion of the scissors-like mechanism 14.

The elastic apparatus 20 comprises a bell-shaped shell portion 22 having a top plate 25 and a curved periphery 23 projecting downward from a peripheral edge of the top plate 25 and defining a cavity 221 therein, a hollow neck portion 24 projecting upward from the peripheral edge of the top plate 25 of the shell portion 22 and defining a recess 242 therein for firmly receiving the engagement protrusion 122 of the keycap 12, an impacting portion 26 projecting downward from the top plate 25, and a base flange 28 radially extending from a bottom peripheral edge of the shell portion 22. The elastic apparatus may be made of rubber or another insulative elastic material.

The positioning portion 16 is formed as a substantially socket-like structure which defines a central hole 162 therein and comprises a plurality of positioning holders 163 formed on an upper surface thereof for supporting a lower portion of the scissors-like mechanism 14 and a recess 164 defined in a lower surface thereof for receiving and retaining the base flange 28 of the elastic apparatus 20.

The circuitry thin film 30 comprises a circuit portion 32 positioned on the conductive base 40 which may be a metal plate or other conductive material. The circuit portion 32 is positioned to confront the impacting portion 26 of the elastic apparatus 20 so that when the elastic apparatus 20 is deformed downward due to a manual depression on the keycap 12 the impacting portion 26 will depress the circuit portion 32 of the circuitry thin film 30, when the circuit portion 32 is depressed it functions like an electrical switch to electrically contact the conductive base 40 thereby resulting in an input of the keyswitch key 99. The elastic apparatus 20 recovers from deformation to return to its original status upon release of the manual depression.

Figure 4:
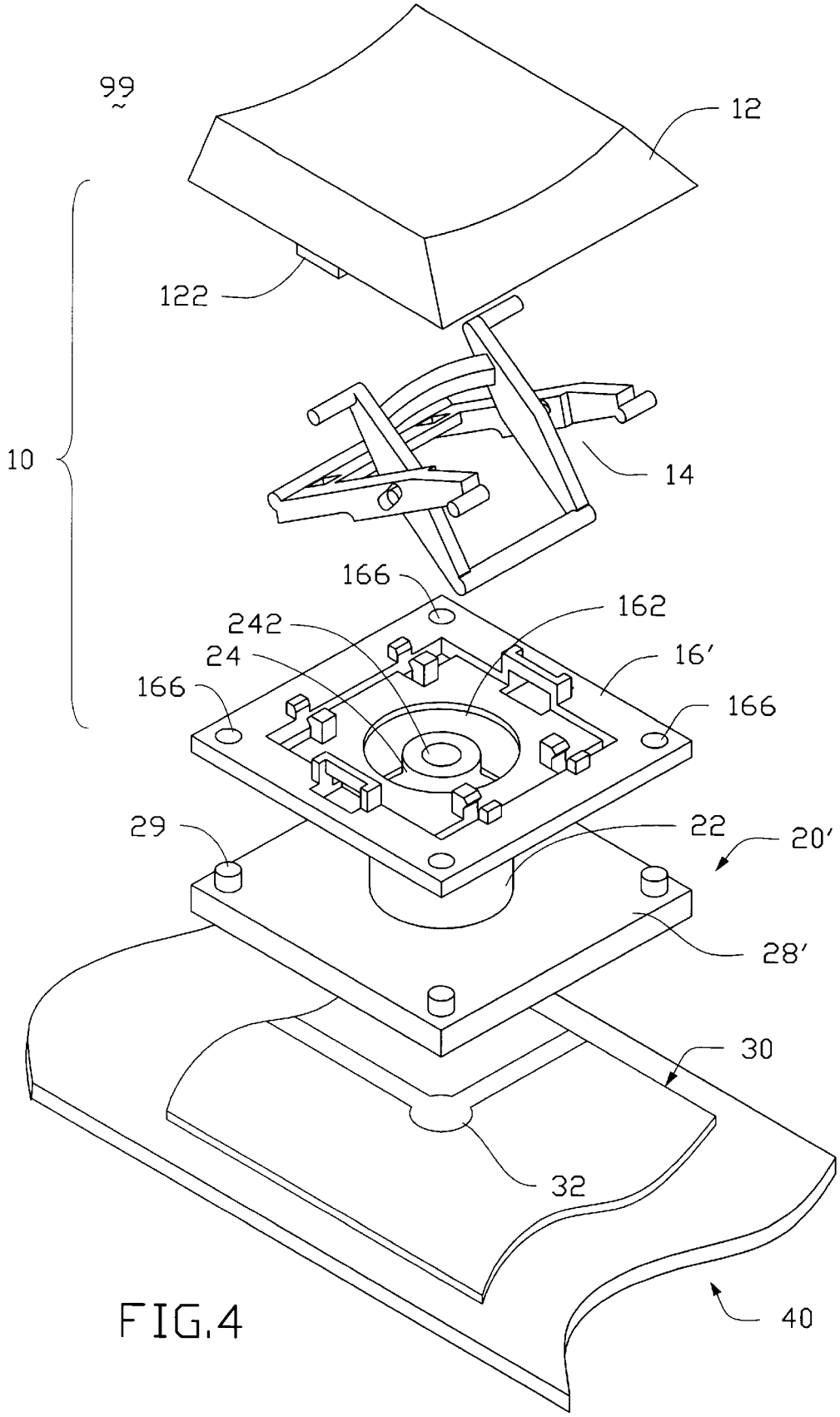
FIG. 4 is an exploded view of a keyswitch key including an elastic apparatus in accordance with a second embodiment of the present invention.
Figure 5:
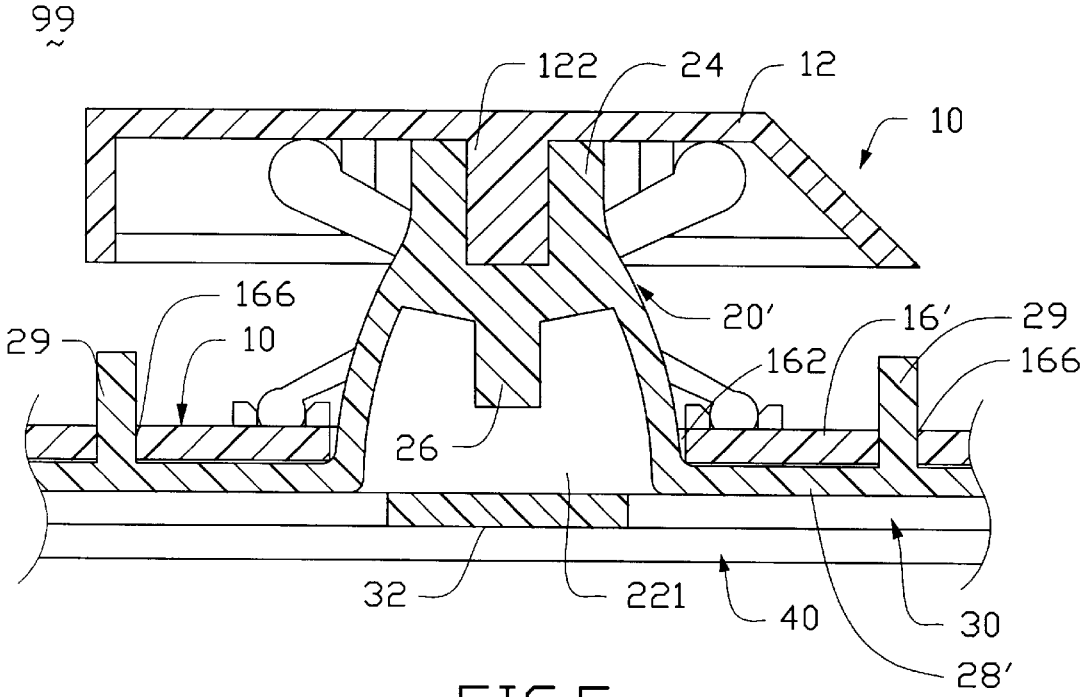
FIG. 5 is a cross-sectional view of the second embodiment of the keyswitch key showing the engagement relation between the elastic apparatus and the keyswitch key.
Figure 6:
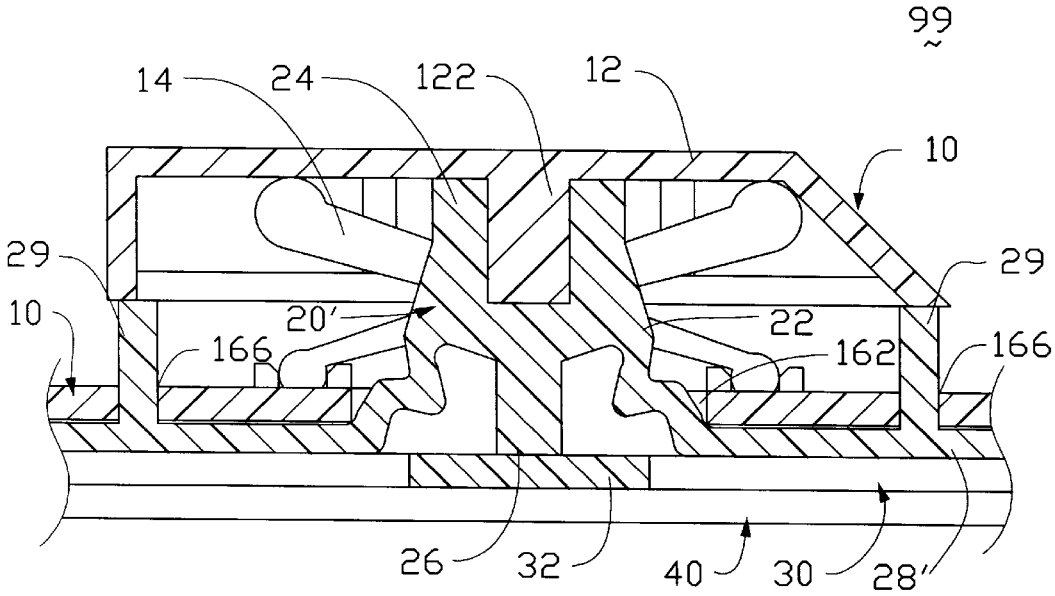
FIG. 6 is an operative view of the second embodiment of the keyswitch key showing the keycap thereof abut against protrusions of the elastic member.

An alternative embodiment of the present invention is similar to the first embodiment except the elastic apparatus 20 and the positioning portion 16. Referring to FIGS. 4 and 5, the elastic apparatus and the positioning portion in the second embodiment are respectively designated a new numeral 20' and 16' for distinguishing from those of the first embodiment. Specifically, the positioning portion 16' of the second embodiment is different from that of the first embodiment in that the thickness thereof is less than that of the positioning portion 16 because of no need of defining the recess 164 in a lower surface thereof. However, for engagement between the positioning portion 16' and the elastic apparatus 20', four small holes 166 are defined in four corners of the positioning portion 16'. The base flange 28 of the first embodiment is changed to a new base flange 28' which has an identical contour with respect to that of the positioning portion 16' and four protrusions 29 projecting therefrom for mating with the four small holes 166 defined in the positioning portion 16'. The protrusions 29 and the holes 166 are suitably sized so that each protrusion 29 can be received in a corresponding hole 166 while leaving an upper portion thereof extending beyond the positioning portion 16'. Referring to FIG. 6, the extended upper portion of the protrusion 29 abuts against a lower periphery of the keycap 12 when the keycap 12 is depressed downward thereby forcing the impacting portion 26 thereof to depress the circuit portion 32. More specifically, the extended upper portion of each protrusion 29 of the elastic apparatus 20' abuts against a lower periphery of the keycap 12 in order to absorb an impact therefrom when the keycap 12 is depressed with an external force beyond an operative force of activating the keyswitch. The clicks noise on the keyswitch may be reduced to a minimum level due to the abutment between the keycap 12 and the protrusions 29 of the elastic apparatus 20'. Therefore, the second embodiment of the present invention can save material (the thickness of the positioning portion 16' is reduced comparing to that of the first embodiment) and also decrease noise during clicks comparing to the first embodiment.

While the present invention has been described with reference to a specific embodiment, the description is illustrative of the invention and is not to be construed as limiting the invention.

Therefore, various modifications to the present invention can be made to the preferred embodiment by those skilled in the art without departing from the true spirit and scope of the invention as defined by the appended claims.

What is claimed is:

1. A keyswitch key of a keyboard comprising:

a keycap;

a scissors-like mechanism having an upper portion supported by the keycap, and a lower portion;

an elastic member firmly connected with the keycap and located in a space defined by the scissors-like mechanism and comprising a shell portion which has a top plate, a receptacle portion projecting upward from a peripheral edge of the top plate of the shell portion, a base flange radially extending from a bottom peripheral edge of the shell portion, a plurality of protrusions projecting upward from the base flange, and an impacting portion projecting downward from the top plate of the shell portion;

a positioning frame defining a first hole in a center thereof for retaining a periphery of the shell portion adjacent to the base flange thereof and a plurality of second holes for receiving the protrusions of the elastic member and allowing upper portions of the protrusions to extend beyond the positioning frame, positioning means formed on an upper surface of the positioning frame for supporting the lower portion of the scissors-like mechanism; and a circuitry member including a circuit unit confronting the impacting portion of the elastic member whereby depression of the impacting portion causes a switch-on status of the circuit unit and returns to a switch-off status upon release of the impacting portion;

whereby the extended upper portions of the protrusions of the elastic member abut against a lower periphery of the keycap in order to absorb an impact therefrom when the keycap is depressed with an external force beyond an operative force of activating the keyswitch key.

2. The keyswitch key as claimed in claim 1, wherein the keycap comprises an engagement portion projecting downward and securely received in the receptacle of the elastic member.

3. The keyswitch key as claimed in claim 1, wherein the receptacle of the elastic member is a hollow neck projecting upward from the top plate of the shell portion.

4. The keyswitch key as claimed in claim 1, wherein the shell portion has a curved periphery extending downward from a peripheral edge of the top plate.

5. The keyswitch key as claimed in claim 1, wherein the impacting portion is a bar projecting downward from the top plate of the shell.

6. The keyswitch key as claimed in claim 1, wherein the positioning means comprises a plurality of positioning holders.

7. A keyswitch key of a keyboard comprising:

a keycap;

a scissors-like structure having an upper portion supported by the keycap and a lower portion;

an elastic member firmly connected to the keycap and located in a space defined by the scissors-like structure, said elastic member including an upper end for retainable engagement with the keycap and a lower end for retainable engagement with a positioning frame, an impacting portion generally projecting downward from said upper end of said elastic member; and said positioning frame defining a hole in a center thereof for receiving said upper end of the elastic member and further defining means for cooperating with the lower end of the elastic member for retaining the elastic member thereto; wherein said means includes a plurality of holes for receivably retaining a corresponding number of protrusions upward extending from the elastic member and said protrusions are long enough for engagement with the keycap for absorption of excess pressing forces and corresponding noises when said impacting portion abuts against corresponding circuits below the elastic member.

* * * * *